United States Patent [19]

Downing

[11] 4,056,295

[45] Nov. 1, 1977

[54] MULTIPLE CONTAINER AND RACK SYSTEM

[75] Inventor: Benjamin A. Downing, Peoria, Ill.

[73] Assignee: Caterpillar Tractor Co., Peoria, Ill.

[21] Appl. No.: 662,798

[22] Filed: Mar. 1, 1976

[51] Int. Cl.[2] ..... A47B 87/00

[52] U.S. Cl. ..... 312/107; 312/111; 312/257 SK; 108/53.5; 108/91

[58] Field of Search ..... 312/107, 111, 257 SK, 312/257 SM, 257 A; 211/194; 108/52, 53, 55, 91

[56] References Cited

U.S. PATENT DOCUMENTS

| | | | |
|---|---|---|---|
| 1,010,801 | 12/1911 | Rapp | 108/53.5 |
| 1,038,923 | 9/1912 | Mathy | 312/111 |
| 1,487,856 | 3/1924 | Hauserman et al. | 312/257 SK |
| 1,682,028 | 8/1928 | Young | 312/107 |
| 2,579,685 | 12/1951 | Loose | 108/55.1 |
| 2,760,743 | 8/1956 | Shaw | 108/53.1 |
| 2,775,360 | 12/1956 | Phillips | 108/53.5 |
| 3,207,095 | 9/1965 | Hiatt, Jr. | 108/53.5 |
| 3,430,588 | 3/1969 | Heyer | 108/91 |
| 3,502,237 | 3/1970 | Verhein et al. | 108/53.1 |
| 3,568,608 | 3/1971 | Taylor | 108/53.5 |

*Primary Examiner*—Paul R. Gilliam
*Assistant Examiner*—Victor N. Sakran
*Attorney, Agent, or Firm*—Eugene C. Goodale

[57] ABSTRACT

A multiple container and rack system is disclosed in which the unit may be used both as a transport and storage module. The rack assembly permits stacking of each module one on top of another. The frame permits the transmission of vertical and longitudinal loads therethrough. Means are provided to secure the frame assembly together such that individual containers may be secured therein.

8 Claims, 11 Drawing Figures

MULTIPLE CONTAINER AND RACK SYSTEM

BACKGROUND OF THE INVENTION

This invention relates generally to storage containers, and more particularly to modularized units which may be combined to form a multiple container and rack system.

There are a multitude of shipping containers and the like available in the art. Examples of such containers may be found in the following U.S. Pat. Nos. Kohlhaas 3,185,379; Heller et al 3,490,769; and Downing et al 3,797,727. These containers are used to store and transport various articles therein. However, once the above-referenced containers are received at the end user, the transported articles therein are most generally removed from such container and stored in a separate storage bin or the like. Hence, this type container is only of general utility in transporting articles.

Storage containers or units in which a multiplicity of articles may be stored in a multiplicity of storage containers or bins are disclosed in the following United States patents Nos: Wilson 3,887,126 and Marquette 3,891,288. The Wilson device has limited utility in that specially designed containers are utilized to fit within the storage rack. The Marquette system is limited in that the rack system is designed for a specific number of containers. The rack system is complete by itself and there are no provisions for expanding the rack system for additional or added storage.

Accordingly, it is an object of the present invention to provide a multiple container and rack system which is formed from a modularized assembly such that the individual modular units may be stacked one upon the other.

A further object of this invention is to provide a multiple container and rack system which may be used for both transporting and storage of articles.

Another object of this invention is to provide a multiple container and rack system in which the rack framework may be readily assembled and disassembled, said rack frame in the assembled condition being stable against vertical and horizontal forces.

SUMMARY

A multiple container and rack system is formed of a modularized frame assembly which permits stacking one on top of the other. The frame post members are formed at the upper ends thereof to readily accept and secure another modular frame therein in the stacked condition. Means permit securing the side assemblies with the end assembly of the modularized unit, yet readily permit disassembly of said unit. A multiplicity of suitable containers are mounted within each individual modular unit.

Other objects, details, uses, and advantages of this invention will become apparent as the following description of the exemplary embodiments thereof presented in the accompanying drawings proceeds.

BRIEF DESCRIPTION OF THE DRAWINGS

The accompanying drawings show present exemplary embodiments of this invention in which.

DESCRIPTION OF ILLUSTRATED EMBODIMENTS

Figure 1:
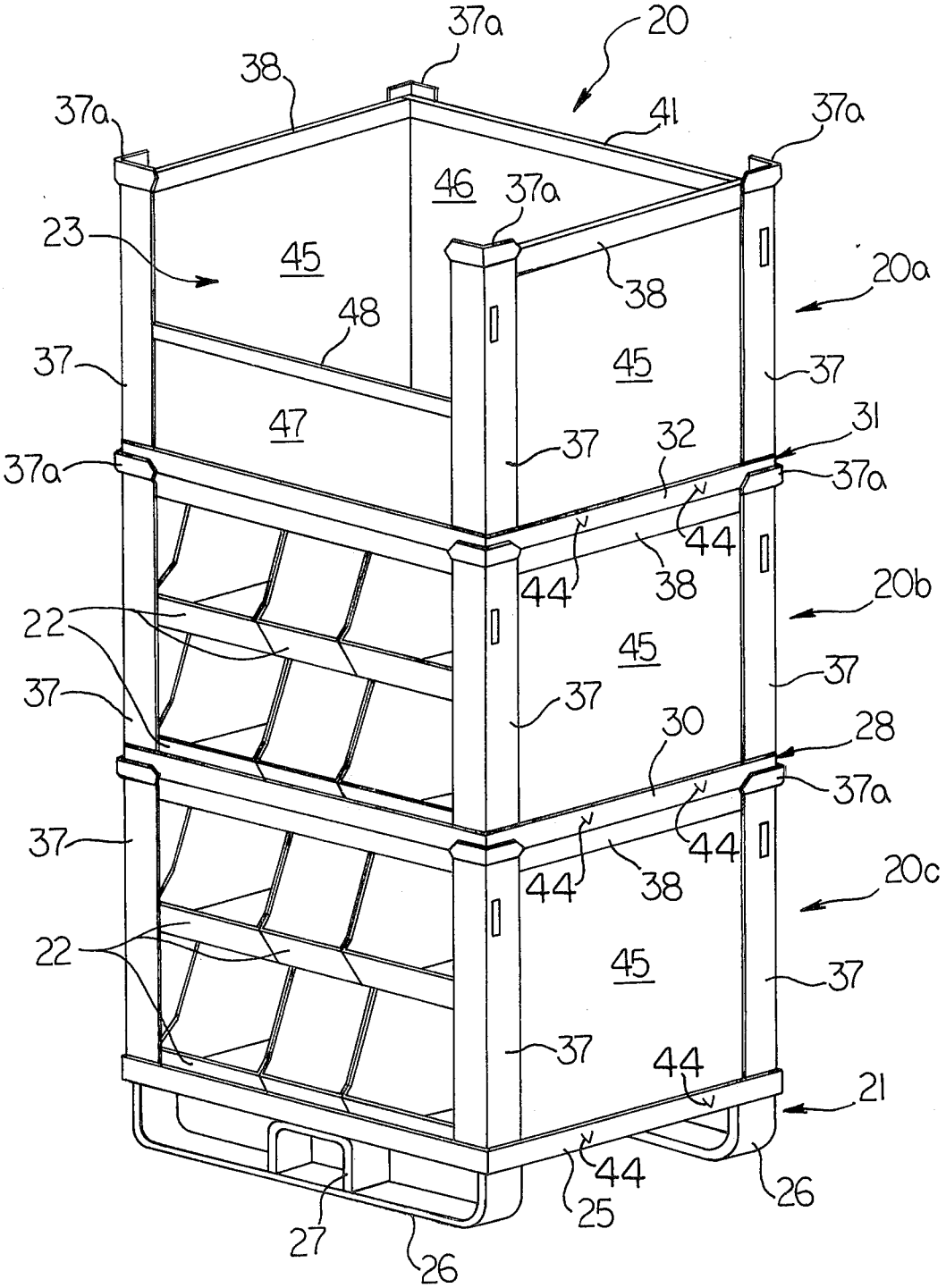
FIG. 1 is a perspective view of the multiple container and rack system of this invention.

Reference is now made to FIG. 1 of the drawings, which illustrates the exemplary embodiments of the improved multiple container and rack system of this invention, which is designated generally by the reference numeral 20. The multiple container and rack system is comprised of a multiplicity of modular units 20*a* 20*b*, and 20*c*. The modular units are supported upon a base member 21. The respective modular units support therewithin a multiplicity of individual containers or bins 22 as seen in modular units 20*b* and 20*c*. Modular unit 20*a* is seen to comprise an open bin 23 which may be used for larger articles.

Figure 2:
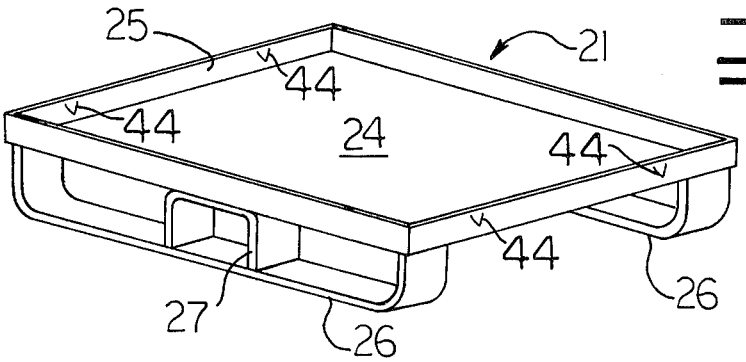
FIG. 2 is a perspective view of the base support member.

Each rack system 20, comprised of a plurality of modular units, is preferably supported upon a base member 21 as seen in FIGS. 1 and 2. The base member 21 may be formed of any suitable substantially rigid material such as steel or wood. The member 21 is generally of a rectangular shape, complementally dimensioned to correspond to the modular units. Each base member 21 includes a base plate 24 having an upstanding restraining means or flange 25 perimetrically oriented about the base plate and suitably secured thereto. A pair of supporting foot members 26 are secured to the base plate 24. The foot members are each reinforced by ribs 27 appropriately spaced to provide convenient openings for accepting standard carriage forks generally associated with material handling fork lift trucks.

Figure 3:
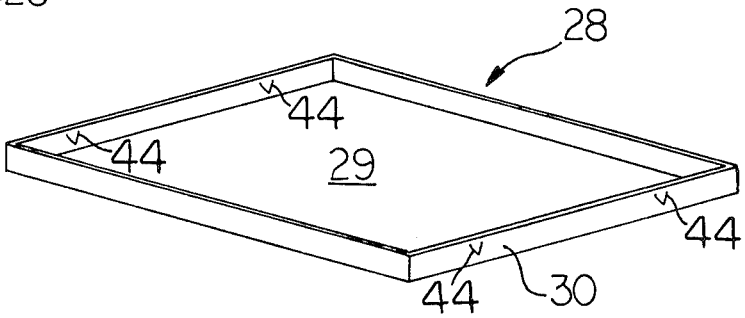
FIG. 3 is a perspective view of a pan member.
Figure 4:
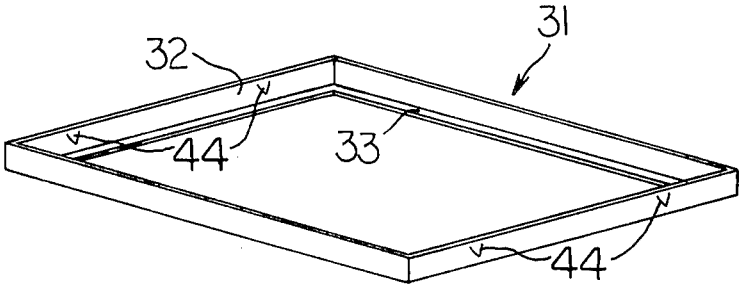
FIG. 4 is a perspective view of a ring assembly.

The stacked modular units seen in FIG. 1 are either supported by a pan member 28 (FIG. 3) or a ring member 31 (FIG. 4). As seen in FIG. 3, the pan member 28 is comprised of a base plate 29 having an upstanding restraining flange 30 secured thereto about the perimeter. It may be noted that the pan member 28 is very similar to the base member 21 except that the pan member 28 does not include the foot members. As seen in FIG. 4, the ring member 31 is comprised of an upstanding flange 32 defining the perimeter of an area substantially the same as the pan member 28. The flange 32 is formed with an inwardly directed supporting lip 33. The pan member 28 and ring member 31 are dimensionally formed so as to be complemental with the frame assembly 34 (FIG. 5) such that the frame assembly 34 is supported in the respective ring or pan member in a relatively tight frictional fit by the respective flanges 30 and 32 or the flange 25 of the base member 21.

Figure 5:
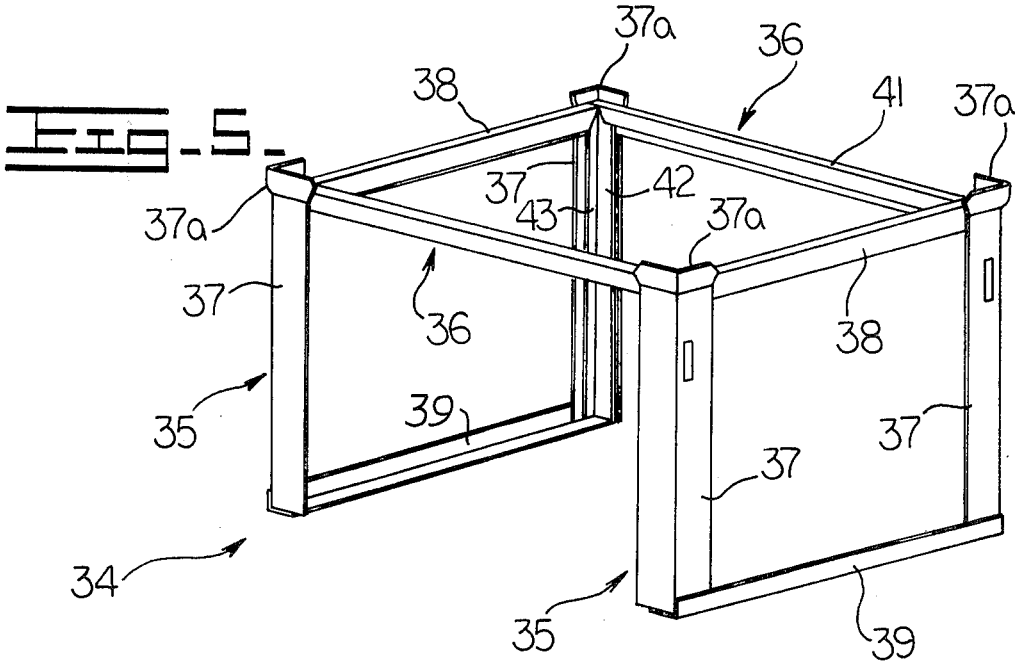
FIG. 5 is a perspective view of an individual modularized frame unit.

The frame assembly 34 is seen in FIG. 5 to comprise a pair of end members 35 and a pair of side members 36. When assembled and combined with a base member, the frame assembly 34 and a suitable base or pan or ring member define a modular unit as shown in FIG. 1. Each base member vertical restrain-member 25, 30, or 32 is formed with inwardly projecting securing means or barbs 44. The barbs 44 are so formed that the frame assembly 34 will be securely retaining within the base member through the cooperation of the barbs 44 with the member 39 of the frame assembly 34. The barbs 44 thus prevent vertical displacement of the frame assembly 34.

Figure 6:
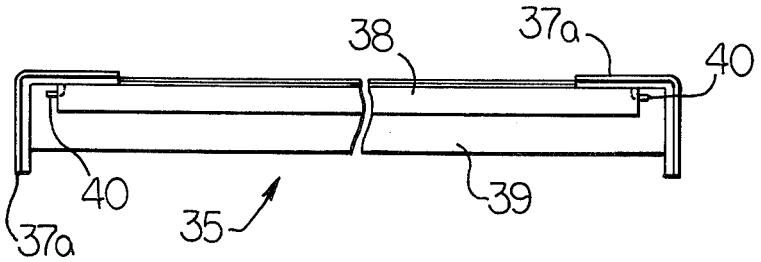
FIG. 6 is a top view of the end assembly.
Figure 7:
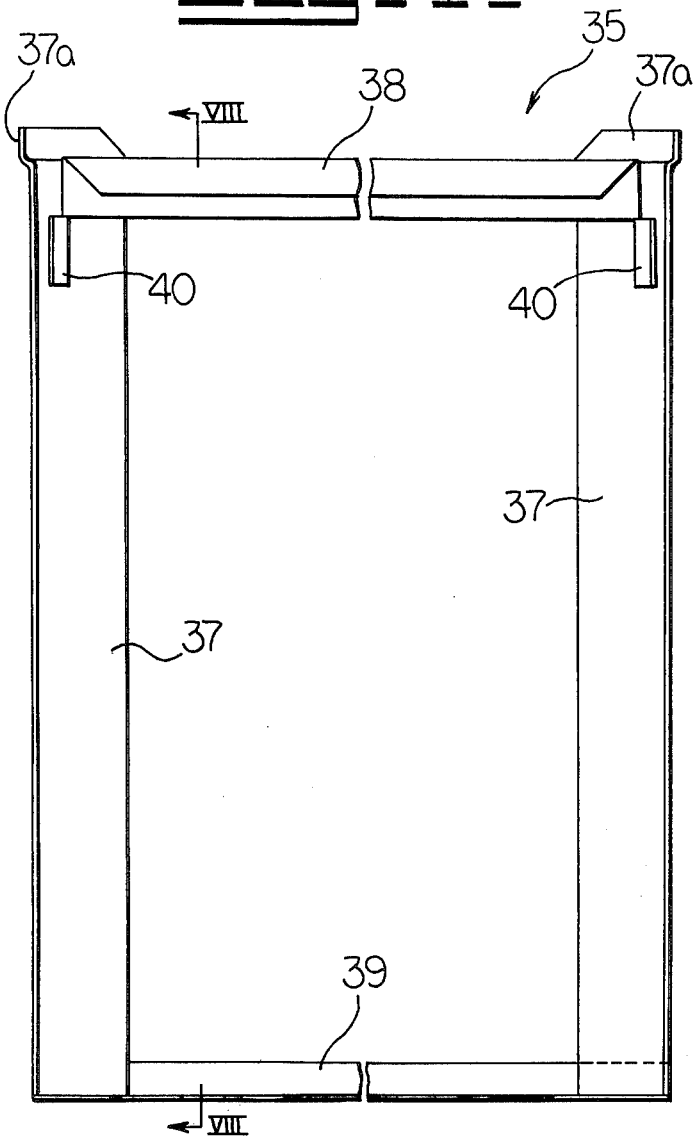
FIG. 7 is a plan view of the end assembly.
Figure 8:
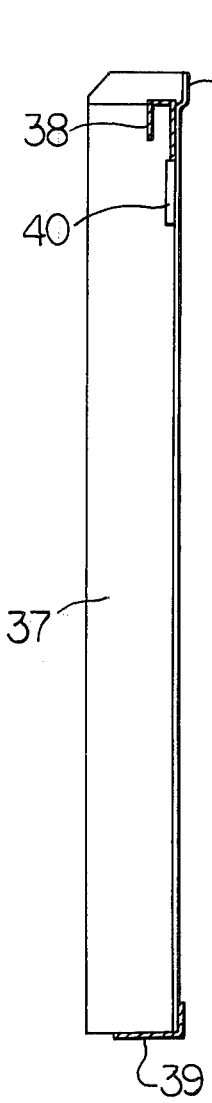
FIG. 8 is a sectional view taken along line VIII—VIII of FIG. 7.

Referring now to FIGS. 6–8, the end member is seen to comprise a pair of corner posts 37 fixably secured by any suitable means at the upper end thereof to a substantially U-shaped rail or flange member 38. Each corner post 37 is formed of an angle member. The upper end of each corner post 37 is flared outwardly at 37*a*. The rail 38 is secured to each post 37 such that the upper surface of the rail 38 substantially aligns with the outward flaring portion of the post 37. When assembled, the outwardly flared portions 37*a* of the respective corner posts are dimensionally formed so as to receive in a tight fit the pan or ring members 28 and 31, as particularly seen in FIG. 1.

The lower end of each corner post 37 is secured by any suitable means to an L-shaped angle member 39. A suitable bottom panel (not shown) of fiberboard or the like is supported by the inwardly projecting portion of angle member 39. The bottom panel urges the end member 35 apart and prevents inward movement of said members due to externally applied forces. In some instances, suitable end panels 45 and side panel 46 (FIG. 1) of fiberboard or the like are placed within the frame assembly 34 to define closed side and end portions.

Figure 9:
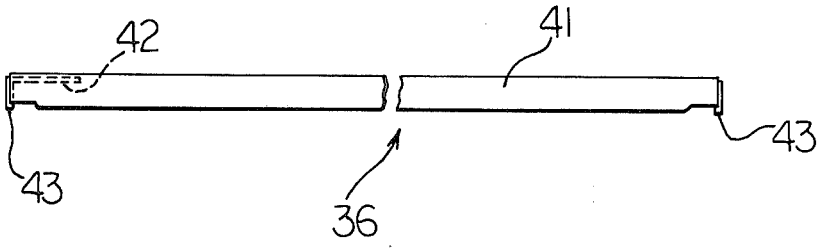
FIG. 9 is a top view of the side assembly.
Figure 10:
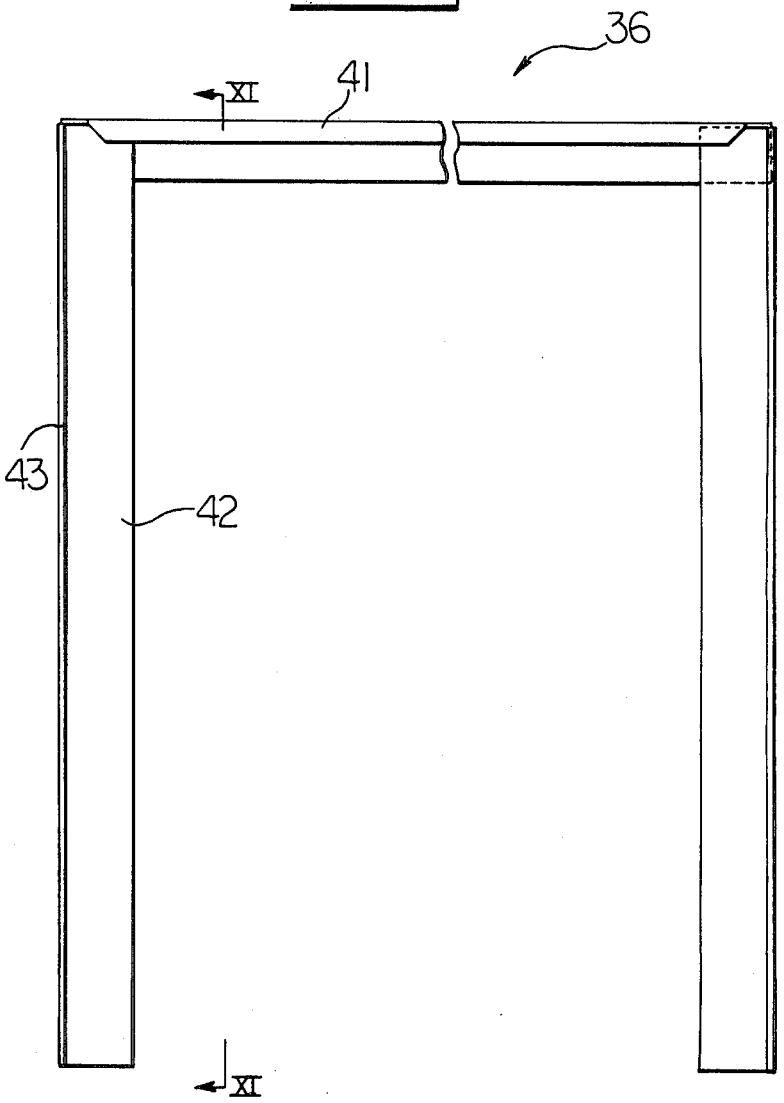
FIG. 10 is a plan view of the side assembly.
Figure 11:
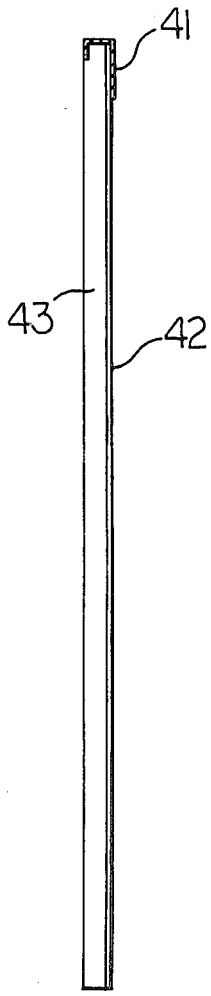
FIG. 11 is a sectional view taken along line XI—XI of FIG. 10.

A guide member 40 is formed near the upper end of each corner post 37. The guide member 40 may be formed in any suitable means. In the example shown, the member 40 is punched out of the corner post 37 and bent inwardly so as to define a sliding channel as seen in FIG. 6. The sliding channel of the guide member 40 cooperatively receives the angle member 43 of the side leg means 42 as seen in FIGS. 9-11. The respective legs 42 are secured at the upper ends thereof by any suitable means to the side rail member 41. The rail member 41 is formed in a substantially U-shape.

The rail members 38 and 41 provide a flat bearing surface for supporting a stacked modular unit thereupon. In addition, the substantially U-shaped rail members permit the end panels 45 and side panels 46 to be retained within the channel portion of the respective rail members. A plurality of containers 22 or the like may then be placed within each module unit to provide compartments for storage and transportation of articles. If the respective containers 22 are of a lesser depth than the depth of the modular unit, the side panel 46 may be removed and additional containers 22 may be inserted from the back side of the modular unit. This would provide dual side entrance to the articles stored within the respective modular unit. In some instances, it may be desirable to utilize the modular unit as an open bin type unit. This use is shown in FIG. 1 as modular unit 20*a*. In this embodiment, a second side panel 47 may be used to define the front of the modular unit. A suitable angle rail 48 is placed over the upper edge of the panel 47 to provide edge protection therefor. The rail 48 may be detachably secured to the corner posts 37 by any suitable means.

As seen in FIG. 1, the respective corner posts 37 of each modular unit are stacked one above the other in the rack system 20. Vertical loads are thus transmitted through the corner posts of each modular unit. It may be further seen that the respective rail members accept and transmit horizontal forces which may be generated by the physical movement of such system. Although FIG. 1 only shows modular units stacked one upon the other, it is possible to stack a second system including the base member 21 upon a modular unit. The foot members 26 are so positioned that they will fit within the area defined by the respective rail members and outwardly flared portions of the corner posts. Although the flared portion 37*a* is shown as being integral with the corner post 37, it is obvious that the flared portion 37*a* could be separated formed and then fixed secured to each corner post.

Any desirable configuration of container 22 may be utilized in each modular unit. A particularly adaptable open faced container is described in my copending application entitled "Collapsible Container" and filed simultaneously herewith.

It is seen that a multiple container and rack system has been described which is readily adaptable for transporting or storage of articles. In addition, the system may be used for both transporting and storage of the same articles. A plurality of modular units are combined to form the versatile system. Each individual modular unit may be easily assembled and disassembled. Accordingly, the objectives hereinbefore set forth have been accomplished.

While present exemplary embodiments of this invention have been illustrated and described, it will be recognized that this invention may be otherwise variously embodied and practiced by those skilled in the art.

What is claimed is:

1. A multiple container and rack system for use both as a transport and storage medium, the system comprising:

a frame assembly, said assembly including a pair of end members, each of said end members including first and second angle corner posts, a rail member fixedly secured at the upper end of each post to maintain said posts from each other the distance of said rail member, and at least one side member, said side member including first and second angle leg members and a rail member fixedly secured to the upper end of said leg members;

means for detachably securing each of said side member angle legs nestably within a respective receiving angle corner post;

base means includes a flange member for receiving said frame assembly therein and thereby defining a modular unit for receipt of articles to be carried thereby;

receiving means on each corner post to permit nestably receipt of one additional modular unit in a stacking manner; restraining means includes at least one inwardly projecting element at each of said flange member upward portions wherein said projecting elements engage the lower angle member of said end member thereby preventing relative vertical displacement thereof; and said restraining means cooperating between said base means and said frame assembly to prevent vertical displacement of said frame assembly from said base means.

2. The container and rack system according to claim 1 in which said securing means is formed on each of said corner posts to define a guide channel therewith for slidable receipt of said side angle leg member.

3. The container and rack system according to claim 2 in which each end member further includes an angle member secured to the lower end of each of said corner posts, said angle member projecting inwardly when said end members and side member are assembled together, said inwardly projecting angle portion providing a support to hold a floor panel for said frame assembly.

4. The container and rack system according to claim 3 in which said receiving means is an outwardly flared upper portion of said corner posts such that said outwardly flared portion of said angled corner post defines a receiving portion, said frame assembly being complementary dimensioned so as to hold said base means of a stacked modular unit therein.

5. The container and rack system according to claim 4 in which said side member rail and said end member rail are substantially U-shaped wherein vertical panels may be placed with each side and end member such that the upper edge of each panel is held within said rail U-shaped portion and further including a second side member;

said system further a plurality of complementally formed containers mountable within each modular unit for receiving articles therein.

6. The container and rack system according to claim 4 in which said base means includes a flange member complementally formed to receive said assembled frame assembly therein, said flange having an upward portion and an inwardly projecting lip support for receiving the lower end of each of said corner posts, said flange member having a peripheral shape and size that is receivable within said corner post flared portion.

7. The container and rack system according to claim 4 in which said base means includes a base plate and upwardly extending flange extending from the perimeter thereof, said base plate and flange receiving the lower end of said corner posts.

8. The container and rack system according to claim 7 in which said restraining means includes at least one inwardly projecting element at each end of said upwardly extending flange wherein said projecting elements engage said lower angle member of said end member thereby preventing relative vertical displacement thereof.

* * * * *